United States Patent [19]

Lebecque

[11] Patent Number: 4,539,914

[45] Date of Patent: Sep. 10, 1985

[54] MULTI-LEVEL STAND, IN PARTICULAR MULTI-LAYER CAKES

[76] Inventor: Maurice Lebecque, 7222, rue Durocher - Apt. 9, Montreal, Quebec, Canada, H3N 1Z9

[21] Appl. No.: 424,590

[22] Filed: Sep. 27, 1982

[51] Int. Cl.[3] ..... A47B 57/00

[52] U.S. Cl. ..... 108/94; 108/149; 312/285; 211/128

[58] Field of Search ..... 108/94, 95, 149; 312/283, 285; 211/128, 130, 113, 119

[56] References Cited

U.S. PATENT DOCUMENTS

| | | | |
|---|---|---|---|
| 197,931 | 12/1877 | Haight | 108/94 |
| 542,346 | 7/1895 | Nielsen | 108/94 |
| 860,019 | 7/1907 | Davis | 108/94 X |
| 1,183,704 | 5/1916 | White | 108/94 |
| 1,278,584 | 9/1918 | Bucheit | 108/94 |
| 1,918,056 | 7/1933 | Platt | 108/94 |
| 1,933,673 | 11/1933 | Krajnc | 108/94 |
| 2,096,410 | 10/1937 | Siegert | 312/285 X |
| 2,945,567 | 7/1960 | Romano | 108/94 |
| 3,169,496 | 2/1965 | Muggli et al. | 108/94 |
| 3,805,965 | 4/1974 | Champagne | 108/94 X |
| 4,426,010 | 1/1984 | LeMer | 108/94 X |

FOREIGN PATENT DOCUMENTS

| | | | |
|---|---|---|---|
| 728435 | 3/1955 | United Kingdom | 211/128 |

*Primary Examiner*—William E. Lyddane
*Assistant Examiner*—Peter A. Aschenbrenner

[57] ABSTRACT

This multi-level stand is particularly adapted to make a multi-layer cake presentation, such as a conventional wedding cake, but at lower cost. The multi-level stands according to the present invention comprise overlying shelves of different sizes to put individual layers of cakes on them, connections between the shelves to allow changing the order of the shelves and to pivotally connect decorative arms for each shelf, and a positioning mechanism connected to the connections between the shelves and constructed and arranged to selectively pivot the decorative arms to allow access on the shelves to insert or remove the layers of cakes.

8 Claims, 15 Drawing Figures

MULTI-LEVEL STAND, IN PARTICULAR MULTI-LAYER CAKES

FIELD OF THE INVENTION

This invention relates to a multi-level stand of the type adapted to achieve a multi-level presentation, such as of a multi-layer wedding cakes.

DESCRIPTION OF THE PRIOR ART

There is still a strong demand for multi-layer cakes at weddings. Such demand is now met by expensive workmanship and/or by recourse to many expedients to replace the now rather expensive conventional wedding cake. Such expedients include using artificial elements and/or spongy cakes rather than the more expensive fruit cakes. The workmanship required to produce such cakes is becoming out of reach to many eventual purchasers.

SUMMARY OF THE INVENTION

It is a general object of the present invention to provide a multi-level stand of the above type, which is adapted to produce a wedding cake presentation, a multi-level display or center piece at relatively low cost and in a practical and attractive manner.

It is another object of the present invention to provide a multi-level stand of the above type, which is adapted to be used to make multi-level cakes, such as wedding cakes, while avoiding problems now encountered to make a conventional wedding cake.

It is still another object of the present invention to provide a multi-level stand of the above type, which is constructed and arranged to allow the production of multi-level cakes or displays that may be decorated in many different and attractive ways and each layer individually.

BRIEF DESCRIPTION OF THE DRAWINGS

The above and other objects and advantages of the present invention will be better understood with reference to the following detailed description of preferred embodiments thereof which are illustrated, by way of example, in the accompanying drawings, in which.

DESCRIPTION OF THE PREFERRED EMBODIMENTS

Figure 1:
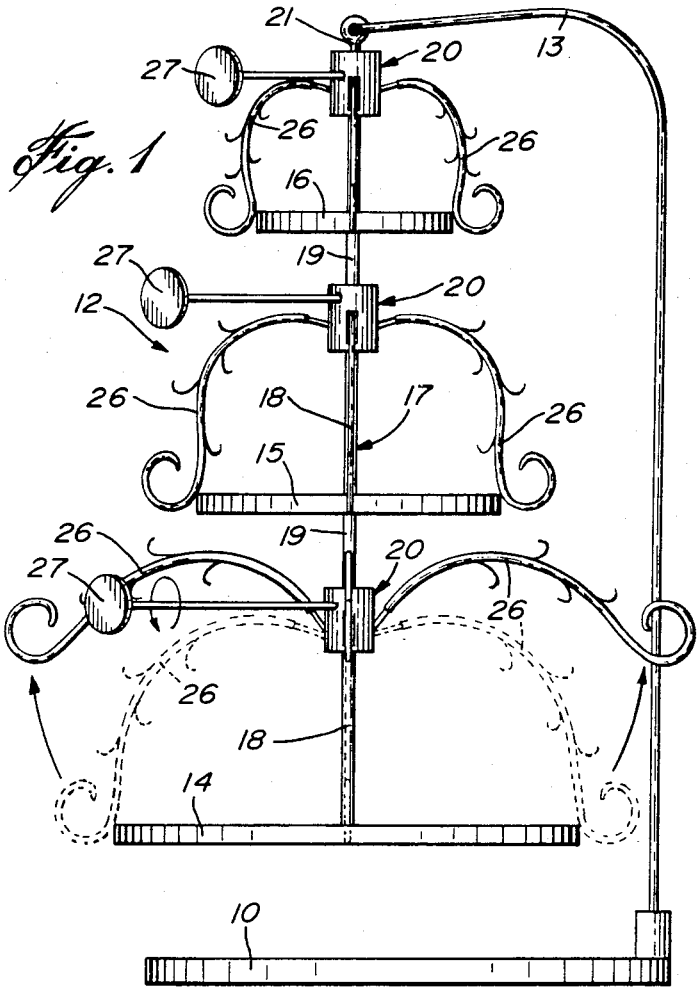
FIG. 1 is an elevation view of a multi-level stand, in particular for tier cakes according to one preferred embodiment of the present invention.
Figure 2:
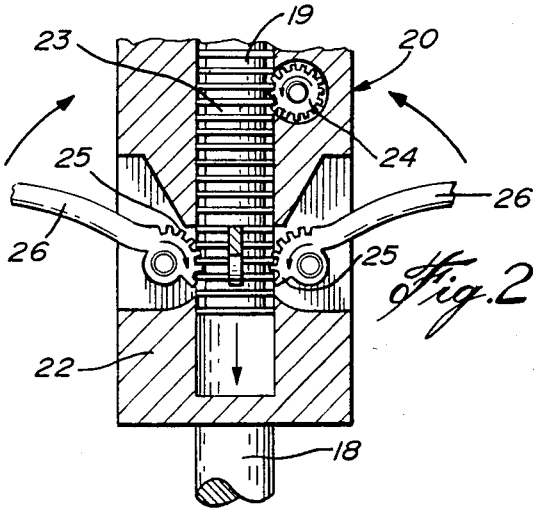
FIG. 2 is a cross-sectional view through a core member forming part of the stand of FIG. 1 to illustrate a positioning mechanism in it.

The multi-level stand of FIGS. 1 and 2 comprises a base 10, a suspension post 11 and a suspended shelf assembly 12. The suspension post 11 has a straight lower end portion secured to the base and a crooked or bent upper end portion 13, to which the shelf assembly 12 is suspended. The suspended shelf assembly includes three shelves 14, 15, 16 in the form of circular plates and a central post 17. The plates 14, 15, and 16 overly one another and are of decreasing sizes to carry cake layers of similar sizes on them.

The portion of the post 17 between the plates or shelves and above the top plate 16 includes a lower post section 18 and an upper post section 19 joined by a connection 20. The lower end of each post section 18 and the upper end of the post sections 18 are fixed to the underlying and overlying plates, respectively. The uppermost upper post section 21 is hooked to the outer end of the crooked portion 13 of the suspension post.

Each connection 20 includes a core member 22 fixedly secured to the upper end of the corresponding lower post section 18. The lower end of each upper post section 19 and 21 is toothed to form a rack gear 23 extending longitudinally of the post in the corresponding core member 22. A positioning mechanism is associated to each core member 22 and includes the corresponding rack gear 23, a pinion gear 24 and a gear sector 25 on the inner end of each corresponding decorative arm 26. The pinion gear 24 and the gear sectors 25 mesh with the corresponding rack gear 23. The pinion gear 24 is rotatable by a control knob 27 and the decorative arms 26 are pivoted on the core member 22. Thus, upon rotation of anyone of the three control knobs 27, the corresponding pinion gear 24 displaces its rack gear 23 and, thus, pivots the corresponding set of decorative arms and elevate or lower the overlying plate or plates. Thus, any particular set of decorative arms 26 may be pivoted between a lowered position to surround a layer of cake on the corresponding plate, and an elevated position to give access on the corresponding plate to place a layer of cake on it, or to remove one from it.

Figure 8:
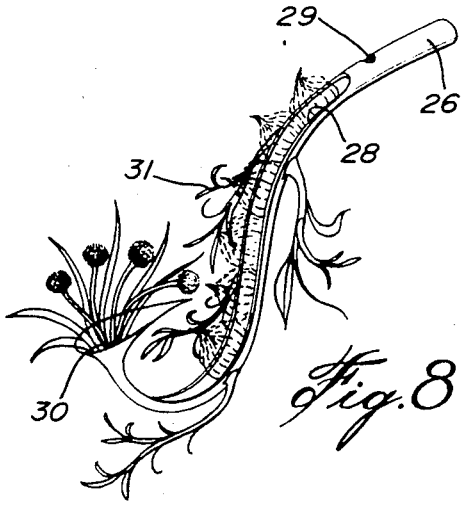
FIG. 8 is a detail view of the outer end of a decorative arm forming part of a multi-level stand according to the present invention.

The decorative arms 26 may have any attractive shape and ornamentation. For instance, as shown in FIG. 8, the decorative arms 26 may be formed with apertures 28, 29, and/or 30, or with some other elements to place flowers 31 or any other ornament along it. Thus, the decorative arms 26 may be ornamented in variable ways.

Figure 3:
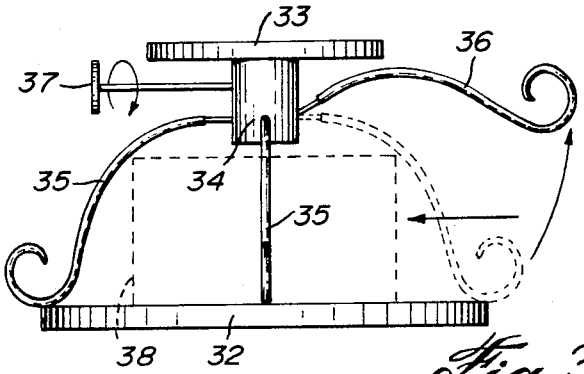
FIG. 3 is a cross-sectional view of a multi-level stand according to another embodiment of the present invention and in which decorative arms support an upper shelf.

The multi-level stand in FIG. 3 includes a base plate 32 and a smaller overlying plate 33. A core member 34 is secured under the top plate 33. Three decorative arms 35 are fixedly secured to the core member 34 and rest on or are fixed to the bottom plate 32. A fourth decorative arm 36 is pivoted to the core member 34 by means of a control knob 37 which is geared to arm 36 in a manner shown in FIG. 5. A layer of cake 38 is placed on the plate 32 when the decorative arm 36 has been elevated by the control knob 37.

Figure 4:
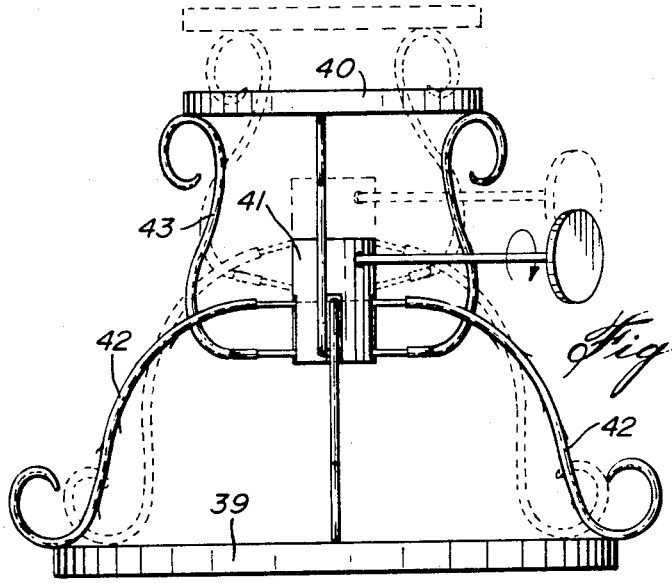
FIG. 4 is an elevation view of a multi-level stand according to still another embodiment of the present invention.
Figure 5:
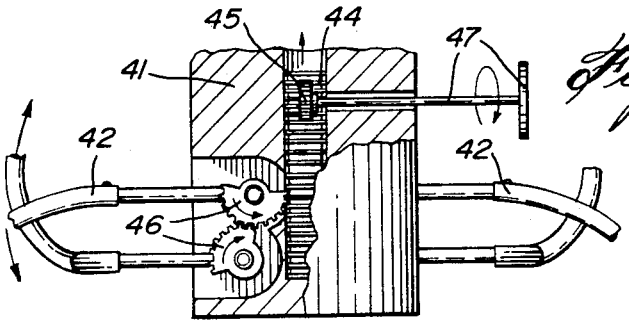
FIG. 5 is an elevation view, with parts broken away, of a core member and associated positioning mechanism forming part of the stand of FIG. 4.

The multi-level stand of FIGS. 4 and 5 includes a base plate 39 and a top plate 40, of smaller size, and overlying the base plate. A connection is provided between the two plates and includes a core member 41. A lower set of decorative arms 42 and an upper set of decorative arms 42 are pivoted to the core member 41 and respectively engage the lower plate 39 and the upper plate 40. A positioning mechanism is attached to the core member 41 and includes a rack gear 44 displaceable endwise up and down in the core member 41, a pinion gear 45 meshing with the rack gear and sector gears 46. A control knob 47 is connected to the pinion gear 45 to displace the rack gear endwise and thus rotate the gear sectors 46 and the arms 42, 43 to which they are secured. The decorative arms 42, 43 may thus be pivoted up and down to elevate or lower the upper plate 40.

Figure 6:
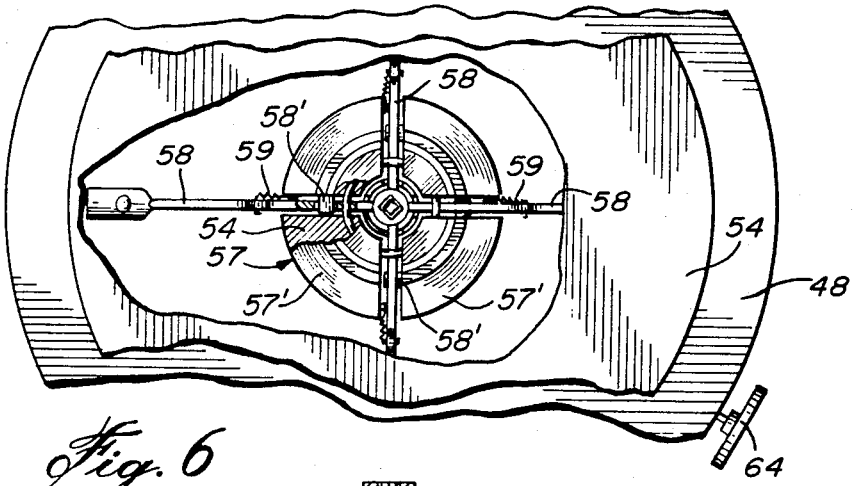
FIG. 6 is a top view, with parts broken away, of a multi-level stand according to another embodiment of the present invention.
Figure 7:
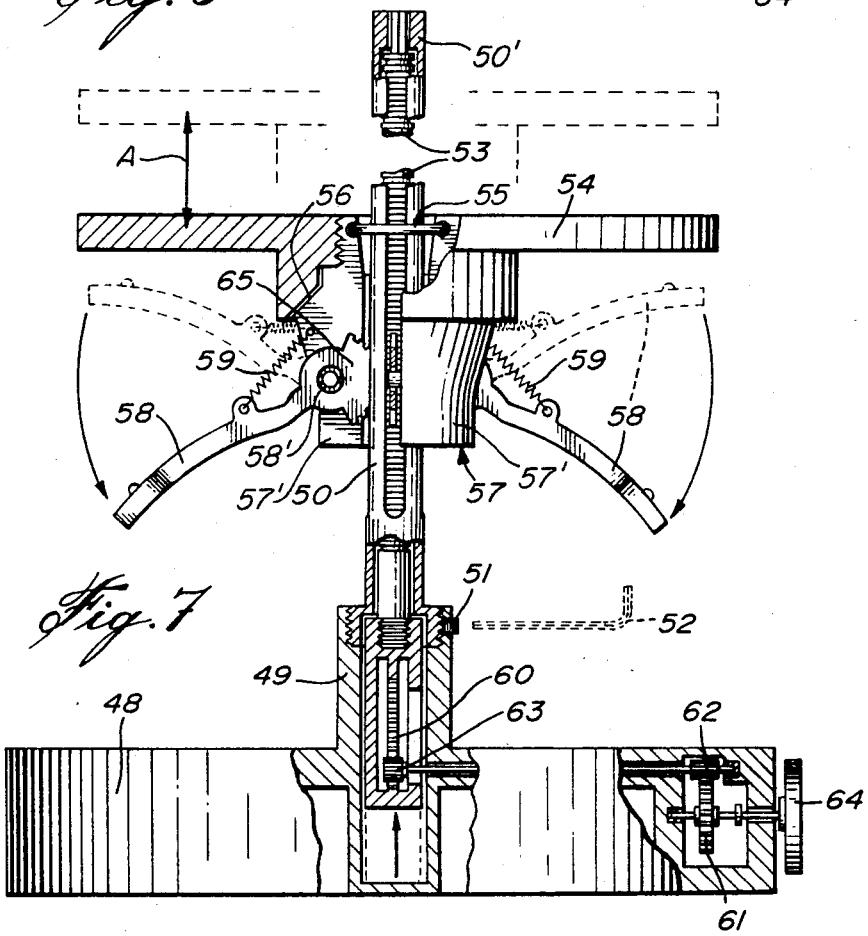
FIG. 7 is an elevation view, with parts broken away, of the multi-level stand of FIG. 6.

The multi-level stand illustrated in FIGS. 6 and 7, includes a base plate 48, made with a tubular hub projection 49, on which is screwed a tubular post 50 secured by a setscrew 51 tightened by an Allen key 52 the top end of post 50 is shown at 50'. A rack gear 53 extends in the tubular post 50. A series of plates or circular shelves 54, only one being shown, are arranged along the tubular post where they are each supported by a core member 57 forming its hub portion. Each core member 57 is formed of four quarters or segments 57' pivotally joined at their upper end by a ring 55 to define as many slots between them in which are pivoted as many decorative arms 58. A spring 59 is attached to each decorative arm 58 to upwardly bias it.

A positioning mechanism is connected to the core members 57 and includes the rack gear 53, an auxiliary rack gear 60 attached at the lower end of the rack gear 53, gears 61, 62, and 63 rotated by a control knob 64 to bodily displace the rack gears up and down and gear sectors 65 at the inner end of each decorative arm to transmit the displacement of the rack gears into pivoting of the decorative arms. As shown in FIG. 6, a pivot pin 58' for each arm 58 is fixed to one quarter 57', extends across the slot but terminates short of the adjacent quarter 57'. Shelf 54 is removably screwed around the top smaller diameter ends of quarters 57' and retains by means of its wedge surface 56 the quarters 57' in operative position with gear sectors 65 meshing with rack gear 53. Upon unscrewing shelf 54 from quarters 57', the latter are now free to pivot outwardly about ring 55, so that the level of the shelves 54 along post 50 can be modified, as shown in FIG. 7, by arrow A. Also, each assembly of shelf 54, core member 57 and arms 58 can be slid off the top end 50' of post 50, so as to interchange the relative position of the shelves 54, the latter normally being of different sizes as in FIG. 1.

Figure 9:
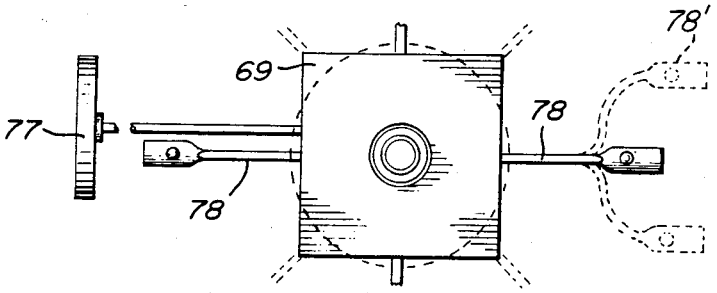
FIG. 9 is a top view.
Figure 10:
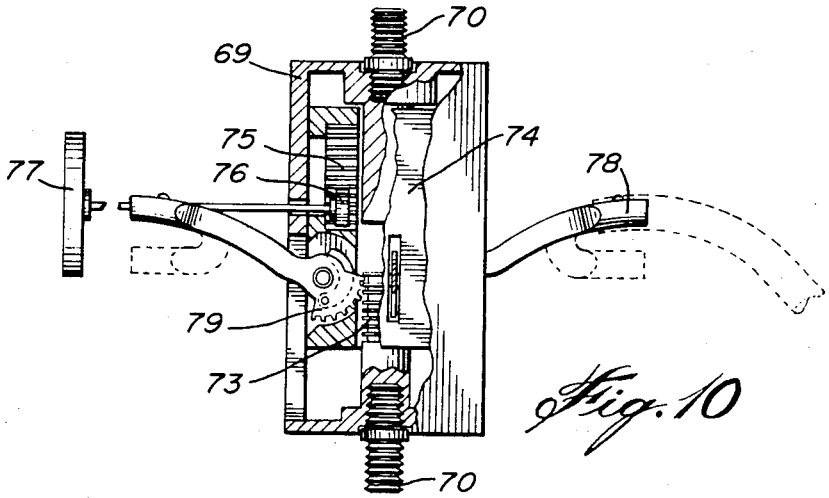
FIGS. 10 and 11 are elevation views, with parts broken away, of a core member and associated positioning mechanism for a multi-level stand according to still another object of the present invention.
Figure 11:
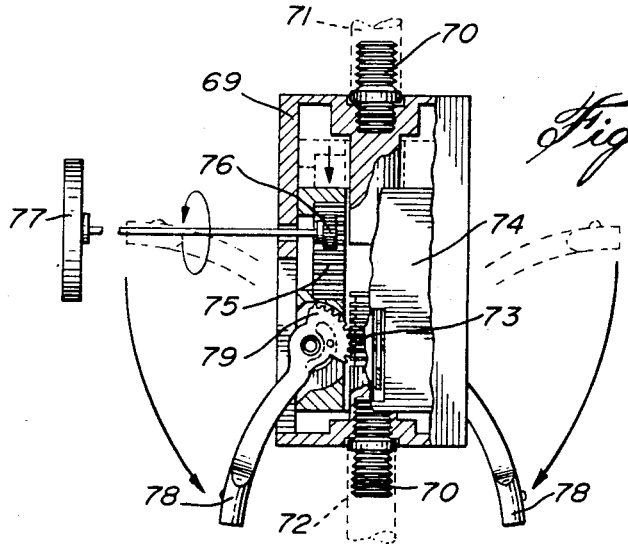
Figure 12:
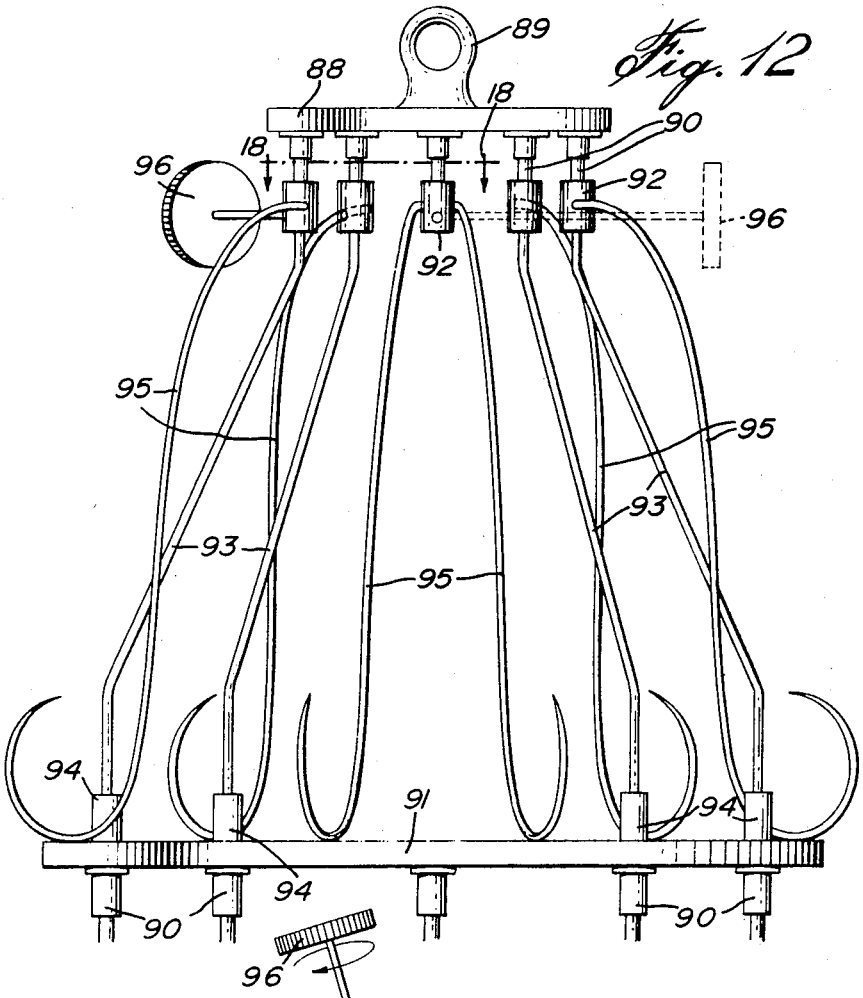
FIG. 12 is an elevation view of a multi-level stand according to still another embodiment of the present invention.
Figure 13:
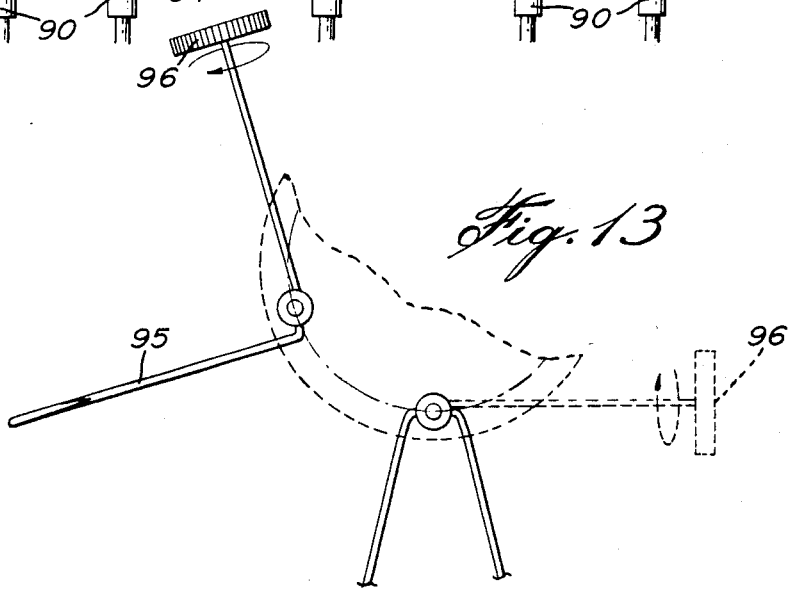
FIG. 13 is a cross-sectional view as seen along line 13—13 in FIG. 12.
Figure 14:
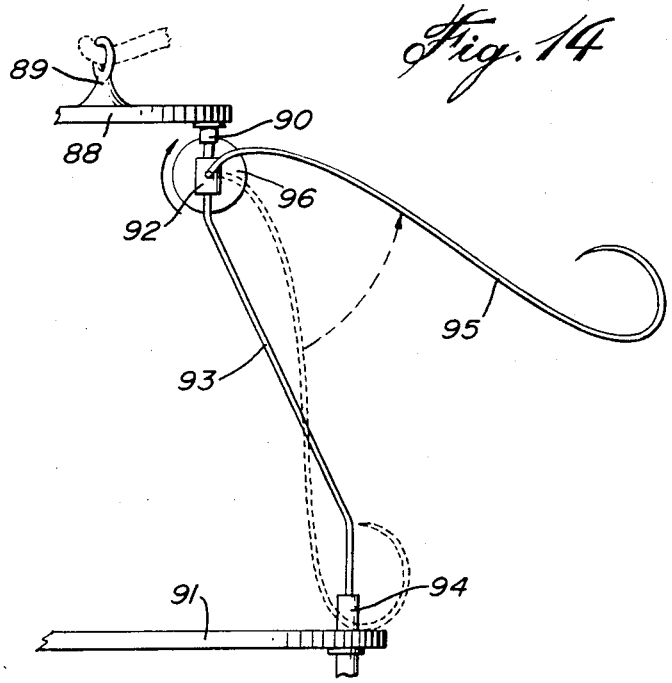
FIGS. 14 and 15 are detailed views of a portion of FIG. 12 and illustrating two different positions of a decorative arm.
Figure 15:
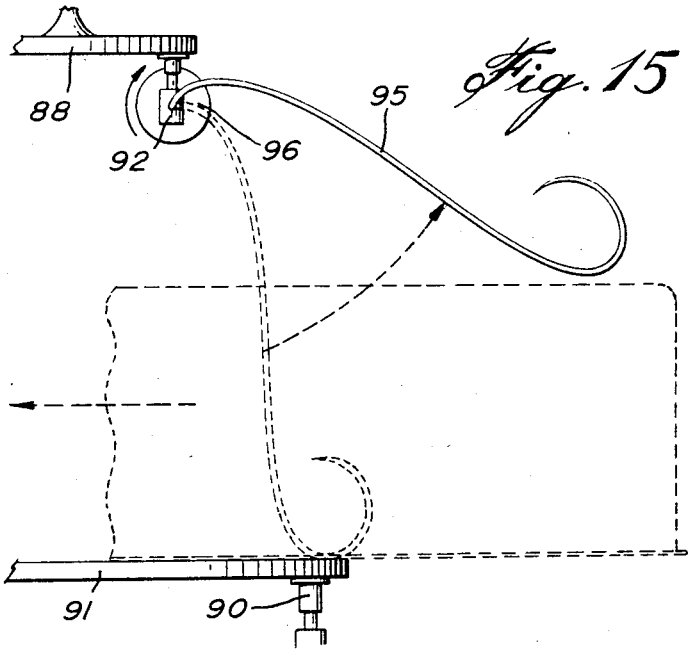

FIGS. 9, 10, and 11 illustrate a connection adapted to replace the connection of FIGS. 1 and 2. This connection includes a core member 69 which is attached by screws 70 to the lower end of an upper post section 71 and the upper end of a lower post section 72 so as to enable interchangeability of the shelves. A rack gear 73 is fixedly secured in the core member 73. A sleeve 74 is displaceable up and down in each core member 69 and a rack gear 75 is formed on the sleeve 74. A pinion gear 76 meshes with the rack gear 75 and is driven by a control knob 77. Decorative arms 78 are pivoted to the sleeve 74 and are each provided with a sector gear 79 meshing with the rack gear 73. Thus, when a control knob 77 is rotated, the rack gear 75 is displaced and so are the decorative arms pivoted to the same sleeve 74. That causes the sector gears 79 to react against the rack gear 73 and, thus, pivot the decorative arms. These arms 78 may have several branches, as indicated at 78' in FIG. 9.

The multi-level stand of FIGS. 12 to 15 inclusive includes a suspension plate 88 provided with a suspension ring 89 to suspend the stand as desired. Posts 90 downwardly project from the top plate 88 and from any underlying plate 91. A connection, including a core member 92, is fixed to the lower of each post 90. Arms 93 rigidly connect some of the posts 90 to an underlying sleeve 94 fixed at the rim of the underlying plate 91. Decorative arms 95 are pivoted to the core members 92 under the control of the knobs 96.

What I claim is:

1. A multi-level stand comprising a pair of vertically-spaced lower and upper shelves, a core member located between said shelves, a lower set and an upper set of decorative arms projecting from and positioned around said core member and pivoted up and down thereto into engagement with said lower shelf and with said upper shelf, respectively and the upper shelf is carried by the corresponding upper set of decorative arms for up-and-down displacement therewith and is carried with the corresponding upper set of decorative arms and core member by the corresponding lower set of decorative arms for up-and-down displacement therewith.

2. A multi-level stand comprising: a plurality of overlying shelves; post means extending between the overlying shelves and interconnecting the same, the post means including a connection positioned above each shelf and each including a pair of post sections defining a pair of adjacent ends and a core member secured to the end of one of the corresponding post sections; a set of decorative arms projecting from and pivoted to each core member; and a positioning mechanism connected to the decorative arms for selective positioning of the decorative arms relative to the shelves, and which includes: a rack gear arrangement provided on the adjacent end of the other one of said post sections and extending longitudinally of the same, a pinion gear rotatively carried by each core member in meshing engagement with the corresponding rack gear arrangement, a control knob connected to each pinion gear to selectively rotate the latter and displace the corresponding rack gear arrangement and said other one of said post sections bodily in the longitudinal direction of the latter, and gear means secured to each decorative arm and in meshing engagement with the corresponding rack gear arrangement for selective pivoting of the decorative arms in response to endwise displacement of the rack gear arrangements.

3. A multi-level stand as defined in claim 2, wherein a set of decorative arms are positioned around each core member and pivoted up and down thereto between a lowered position of engagement with an underlying shelf and an elevated position allowing clear access onto the same underlying shelf.

4. A multi-level stand as defined in claim 3, further including a base, a suspension post having a lower end secured to the base and a crooked upper end portion overlying the base, and said post means includes an upper end suspendingly attached to the crooked upper end of the suspension post.

5. A multi-level stand as defined in claim 2, wherein the core member is secured to the adjacent ends of each pair of post sections, an inner sleeve member is displaceable in each core member longitudinally of the post sections, the decorative arms are pivotally carried by the inner sleeve members, and the positioning mechanism includes a rack arrangement fixedly secured to the corresponding core member and extending longitudinally of the post sections, an auxiliary rack gear provided on each inner sleeve member and longitudinally extending axially thereof, a pinion gear rotatively carried by each core member in meshing engagement with the corresponding rack gear arrangement, a control knob connected to each pinion gear to selectively rotate the latter and displace the corresponding auxiliary rack gear and inner sleeve member, bodily in the longitudinal direction of the post sections, and gear means secured to each decorative arm in meshing engagement with the corresponding rack gear arrangement for selective pivoting of the decorative arms in response to endwise displacement of the auxiliary rack gear and inner sleeve members.

6. A multi-level stand comprising: a stack of vertically-spaced shelves; support means extending between the shelves and supporting the same in stacked relation; a core member carried by said stack over each shelf; a decorative arm projecting from and pivoted to each core member at its inner end, each decorative arm pivotable between a closed position and an open position in which the outer end of said decorative arm is respectively close to and spaced from the shelf underlying the core member to which said decorative arm is pivoted, to respectively embrace and allow access to articles on said underlying shelf; and manually-operated positioning means connected to the decorative arms of each core member for pivoting the latter between said closed and open positions, and which includes: a rack gear arrangement longitudinally displaceable up and down in each core member; a pinion rotatively carried by each core member in meshing engagement with the corresponding rack gear arrangement; a control knob connected to each pinion to selectively rotate the latter and displace the corresponding rack gear arrangement longitudinally in the up-and-down direction, and gear means secured to each decorative arm in meshing engagement with the corresponding rack gear arrangement for selective pivoting of the decorative arms in response to displacement of the rack gear arrangement.

7. A multi-level stand as defined in claim 6, wherein said positioning means are common to all the pivoted decorative arms of all the core members to pivot said pivoted decorative arms simultaneously between open and closed positions; each core member surrounding said central post and consisting of several core segments pivotally interconnected at their upper ends for pivotal movement of said core segments outwardly of said post, each pivoted decorative arm pivoted to one core segment below the pivotal interconnection of said upper ends, the gear means secured to said decorative arms becoming out of meshing engagement with said rack gear arrangement to enable level adjustment of said core member along said post, and each core member removably secured to a shelf and surrounded by the same and depending therefrom; said shelf, when assembled with a core, restraining said core segments against outward pivoting and maintaining said gear means in meshing engagement with said rack gear arrangement.

8. A multi-level stand as defined in claim 7, wherein said support means include a central post extending through said shelves and positioning means include a rack gear arrangement longitudinally displaceable up and down within said post and through all the core members, a pinion gear rotatively carried in meshing engagement with the rack gear arrangement, a control knob connected to the pinion gear to selectively rotate the latter and displace the rack gear arrangement longitudinally in the up-and-down direction, and gear means secured to each decorative arm in meshing engagement with the rack gear arrangement for selective up-and-down pivoting of the decorative arms in response to the displacement of the rack gear arrangement.

* * * * *